US010511129B1

(12) United States Patent
Jung et al.

(10) Patent No.: US 10,511,129 B1
(45) Date of Patent: Dec. 17, 2019

(54) POWER CONNECTOR

(71) Applicants: Hyundai Motor Company, Seoul (KR); Kia Motors Corporation, Seoul (KR)

(72) Inventors: Yun Jae Jung, Gyeonggi-do (KR); Han Joon Jeon, Gangseo-gu (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/205,175

(22) Filed: Nov. 29, 2018

(30) Foreign Application Priority Data

Aug. 28, 2018 (KR) ..... 10-2018-0101442

(51) Int. Cl.

| | |
|---|---|
| ***H01R 24/00*** | (2011.01) |
| ***H01R 13/688*** | (2011.01) |
| ***H01R 13/506*** | (2006.01) |
| ***H01R 13/24*** | (2006.01) |
| ***H01R 13/52*** | (2006.01) |

(52) U.S. Cl.
CPC ..... *H01R 13/688* (2013.01); *H01R 13/2457* (2013.01); *H01R 13/506* (2013.01); *H01R 13/5202* (2013.01)

(58) Field of Classification Search
CPC ..... H01R 23/025; H01R 103/00; H01R 13/6277; H01R 4/646; H01R 23/688
USPC ..... 439/676, 695, 349, 98, 108
See application file for complete search history.

(56) References Cited

U.S. PATENT DOCUMENTS

| | | | | |
|---|---|---|---|---|
| 8,052,481 | B2 * | 11/2011 | Azad | H01H 85/202 439/676 |
| 10,218,130 | B1 * | 2/2019 | Jung | H01R 13/688 |
| 2007/0093089 | A1 * | 4/2007 | Ford | H01H 9/10 439/76.2 |

FOREIGN PATENT DOCUMENTS

| | | | |
|---|---|---|---|
| KR | 20-0455204 | Y1 | 8/2011 |
| KR | 10-2011-0137822 | A | 11/2012 |
| KR | 10-2012-0061822 | A | 10/2013 |
| KR | 10-2013-0094831 | A | 8/2014 |
| KR | 10-2016-0122603 | A | 10/2016 |

* cited by examiner

*Primary Examiner* — Phuong Chi Thi Nguyen
(74) *Attorney, Agent, or Firm* — Morgan, Lewis & Bockius LLP

(57) ABSTRACT

A power connector may include a plurality of fuses; a first terminal connected to a first wire connected to a power source and the first terminal including a plurality of first terminal portions for supplying power; an intermediate terminal connected to a second wire connected to the power source and the first terminal including a plurality of first clips each connected to first end portions of the plurality of fuses; and a plurality of second terminals each including a second clip connected to each of the second end portions of the plurality of fuses and a second terminal portion for supplying power, distributing the power to a plurality of devices.

9 Claims, 11 Drawing Sheets

POWER CONNECTOR

CROSS-REFERENCE TO RELATED APPLICATION(S)

The present application claims priority to Korean Patent Application No. 10-2018-0101442, filed on Aug. 28, 2018 in the Korean Intellectual Property Office, the entire contents of which is incorporated herein for all purposes by this reference.

BACKGROUND OF THE INVENTION

Field of the Invention

The present invention relates to a power connector, and more particularly, to a power connector including a fuse.

Description of Related Art

Power connectors allow a power source to be connected to devices that use electricity. Among these power connectors, there is a connector with a built-in fuse to prevent an overcurrent from flowing into a device.

The fuse is detachably mounted to the connector, and thus if the fuse is blown due to an overcurrent, it may be detached from the connector and replaced.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a power connector configured for distributing power to a plurality of devices.

Various aspects of the present invention are directed to providing a power connector configured for stably maintaining a state in which a fuse is disposed on clips.

Additional various aspects of the present invention will be set forth in part in the description which follows and, in part, will be obvious from the description, or may be learned by practice of the disclosure.

In accordance with one aspect of the present invention, a power connector including a plurality of fuses, a first terminal connected to a first wire connected to a power source and including a plurality of first terminal portions for supplying power, an intermediate terminal connected to a second wire connected to the power source and including a plurality of first clips connected to first end portions of the plurality of fuses, and a plurality of second terminals including second clips connected to second end portions of the plurality of fuses and second terminal portions for supplying power.

The first terminal may include a first connection portion connected to the first wire, and a pair of first terminal portions extending from opposite end portions of the first connection portion, the intermediate terminal may include a second connection portion connected to the second wire, and a pair of first clips provided at opposite end portions of the second connection portion, and the plurality of second terminals may include a pair of second terminals.

The power connector may further include an internal body provided with an accommodating space in which the first terminal, the second terminals, and the intermediate terminal are disposed, and an internal cover covering the accommodating space.

The power connector may further include a sealing member sealing a gap between the internal body and the internal cover.

Each of the plurality of fuses may have a circular cross-section, and the first clips and the second clips each include a pair of clip portions formed in an arc shape corresponding to the fuse and having internal circumferential surfaces face each other, and a pair of guide portions extending from the pair of clip portions to guide the fuse into the pair of clip portions.

The internal cover may include a pair of support ribs supporting the external surfaces of the pair of clip portions.

The internal cover may include a pressing rib provided between the pair of support ribs to press the guide portions.

The internal cover may include a pair of pressing ribs protruding from mutually facing surfaces of the pair of support ribs to respectively support the clip portions.

The internal body may include a plurality of locking protrusions protruding from an external surface of the internal body, and the internal cover may include a plurality of retaining portions extending from external end portions of the internal cover, and a plurality of retaining holes provided at the plurality of retaining portions, into which the plurality of locking protrusions is inserted.

The power connector may further include a main housing having an accommodating space accommodating the internal body, and a cover housing covering the accommodating space, wherein the internal body may include a pair of connector parts in which the first terminal portions and the second terminal portion are respectively disposed, and the cover housing may include a through hole through which the pair of connector parts protrude.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
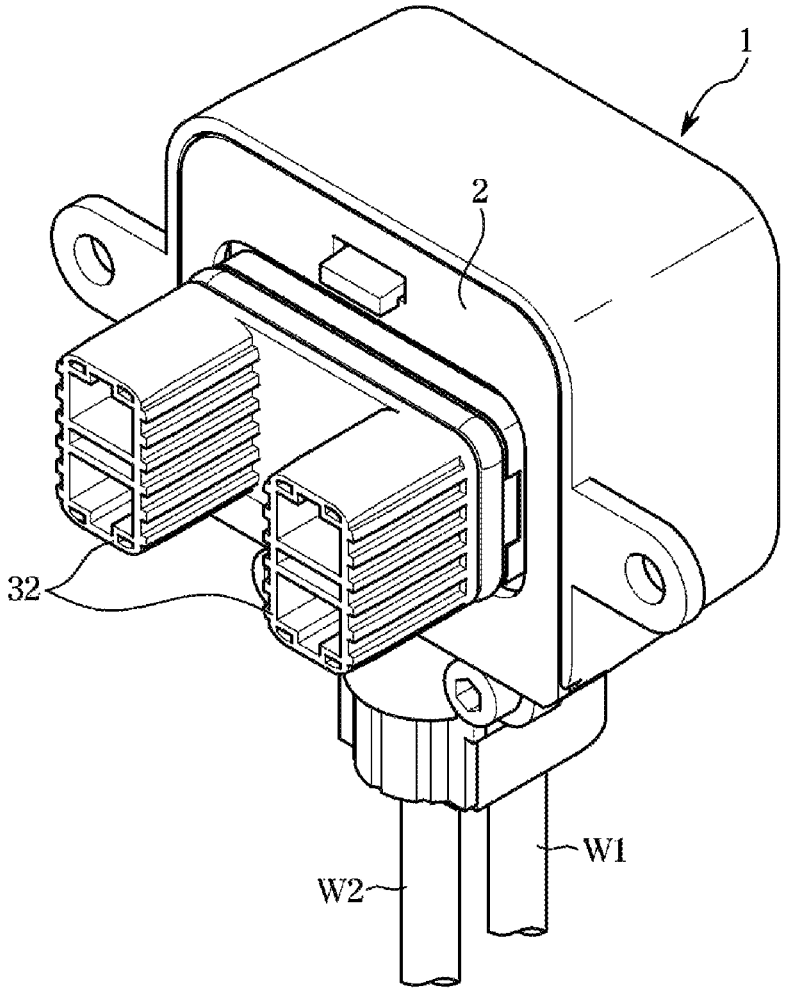
FIG. 1 is a perspective view of a power connector according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

The exemplary embodiments described herein and the configurations shown in the drawings are only examples of exemplary embodiments of the present invention, and various modifications may be made at the time of filing of the present invention to replace the exemplary embodiments and drawings of the present specification.

The same reference numerals or symbols shown in the drawings indicate components or parts performing substantially the same function.

The terms used herein are for describing the exemplary embodiments and are not intended to limit and/or to limit the included disclosure. The singular expressions herein may include plural expressions, unless the context clearly dictates otherwise. Also, the terms "comprises" or "has" are intended to indicate that there are features, numbers, steps, operations, elements, parts, or combinations thereof described in the specification, and do not exclude the presence or addition of one or more other features, numbers, steps, operations, elements, parts, or combinations thereof.

The terms "upper end", "lower end", and the like used in the present specification are defined with reference to the drawings, and the shape and position of each component are not limited by the present term.

Hereinafter, embodiments according to an exemplary embodiment of the present invention will be described in detail with reference to the accompanying drawings.

Referring to FIG. a power connector according to an exemplary embodiment of the present invention is connected to one end portion of a first wire W1 and one end portion of a second wire W2, to which power is supplied. The power connector may include a main housing 1 and a cover housing 2, which form an appearance of the power connector. The power connector also may include connector parts 32 that protrude from a side of the main housing 1 and the cover housing 2 to be connected to external devices, in the exemplary embodiment of the present invention, the two connector parts 32 may be provided to distribute the power to two devices.

Figure 2:
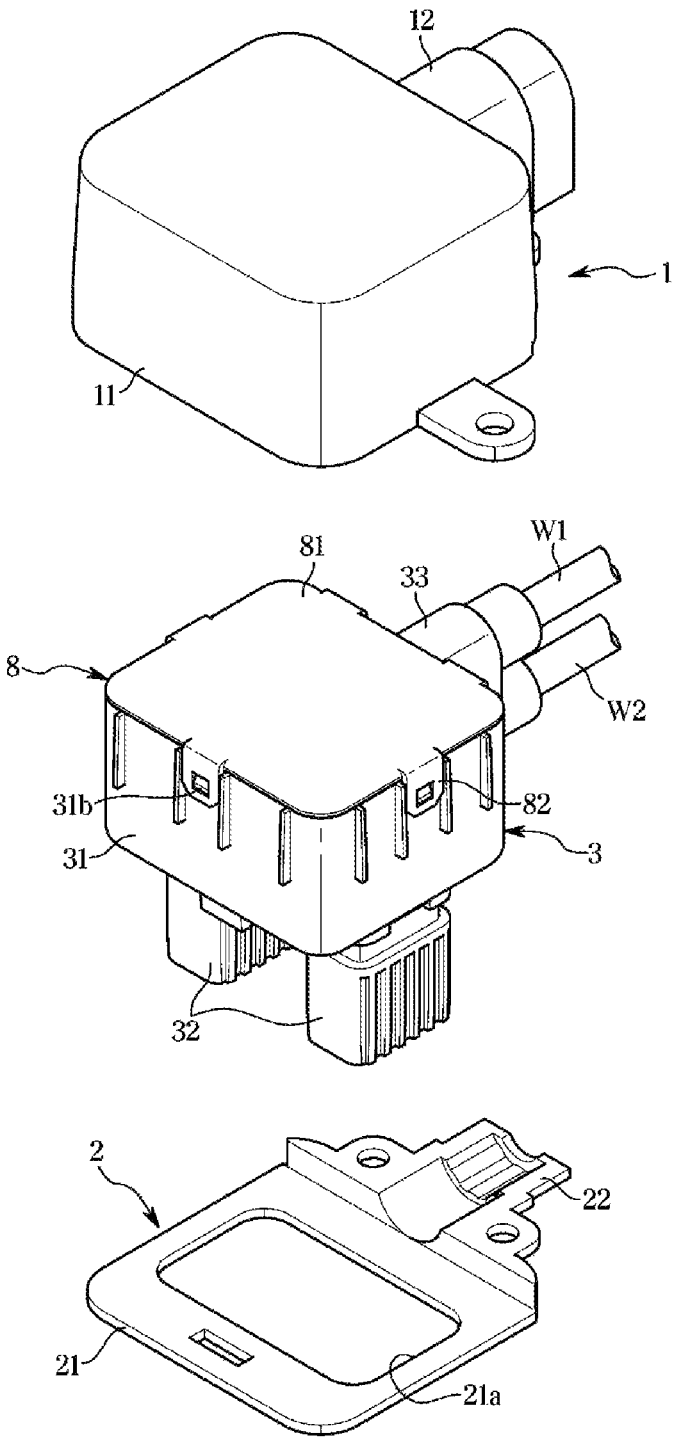
FIG. 2 is an exploded perspective view of housings of a power connector according to an exemplary embodiment of the present invention.

Referring to FIG. 2, the main housing 1 forms an accommodating space 11*a* (see FIG. 8) in which an internal body 3 is accommodated, and the cover housing 2 is coupled to the main housing 1 to close the accommodating space 11*a*.

The main housing 1 and the cover housing 2 include wire supports 12 and 22 for supporting the first wire W1 and the second wire W2, respectively.

The cover housing 2 includes a housing cover portion 21 for covering the accommodating space 11*a*, and a through hole 21*a* provided at the housing cover portion 21 so that the connector parts 32 may protrude through the cover housing 1.

Figure 3:
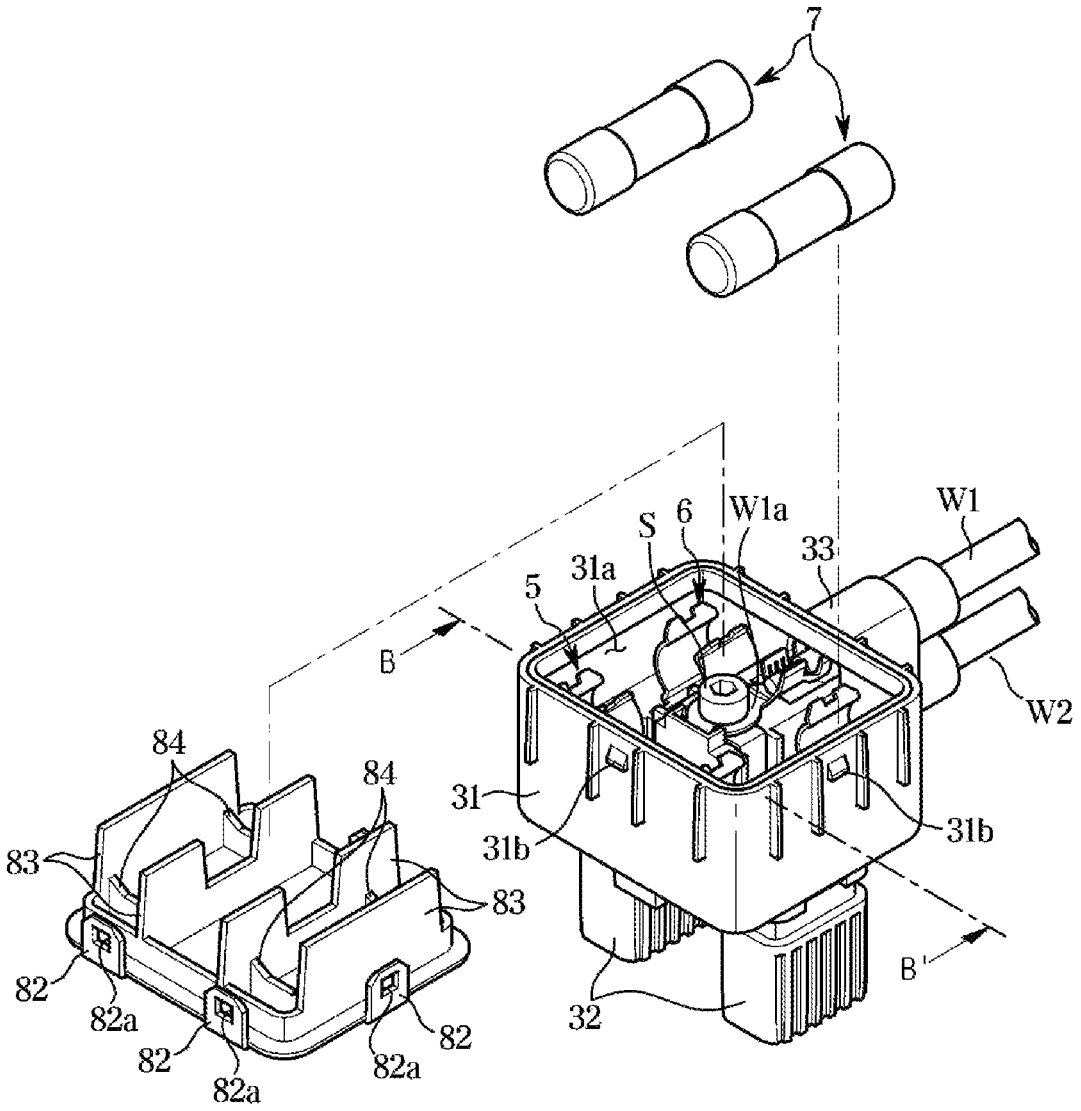
FIG. 3 is an exploded perspective view of an internal body and an internal cover of a power connector according to an exemplary embodiment of the present invention.
Figure 4:
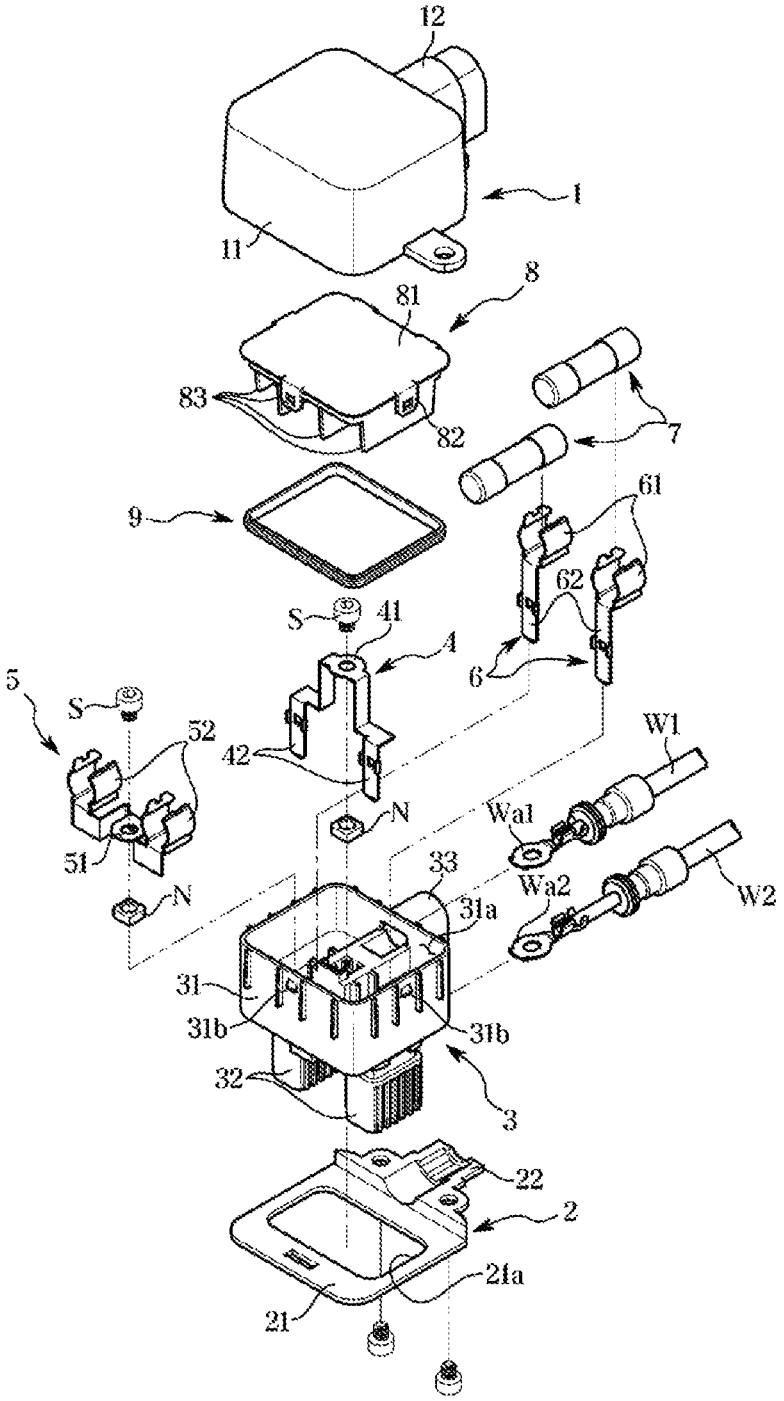
FIG. 4 is an exploded perspective view of a power connector according to an exemplary embodiment of the present invention.

As shown in FIG. 3 and FIG. 4. the power connector includes the internal body 3 disposed inside the main housing 1 and the cover housing 2 and having an accommodating space 31*a* to accommodate internal components of the power connector, and an internal cover 8 for covering the accommodating space 31.*a*.

The internal body 3 includes locking protrusions 31*b* protruding from its external surface, and the internal cover 8 includes an internal cover portion 81 for covering the accommodating space 31*a* and retaining portions 82 extending from external end portions of the internal cover portion 81. The retaining portions 82 are provided with retaining holes 82*a* into which the locking protrusions 31*b* are inserted. Therefore, when the internal cover 8 is attached to the internal body 3 and the accommodating space 31*a* is closed by the internal cover 8, the locking protrusions 31*b* are inserted and engaged in the retaining holes 82*a* so that the state in which the internal cover 8 is attached to the internal body 3 is maintained.

A sealing member 9 is disposed between the internal body 3 and the internal cover 8 to prevent moisture from penetrating into the accommodating space 31*a*.

A plurality of fuses 7 for preventing transmission of an overcurrent and a plurality of terminals 4, 5, and 6 for distributing power supplied to the power connector to a plurality of devices are accommodated in the internal body 3.

The plurality of fuses 7 are each formed as a cylindrical fuse formed in a substantially cylindrical shape.

The plurality of terminals 4, 5, and 6 are each made of elastically deformable conductive material. The terminals 4, 5 and 6 may be formed by bending a metal plate.

Figure 5:
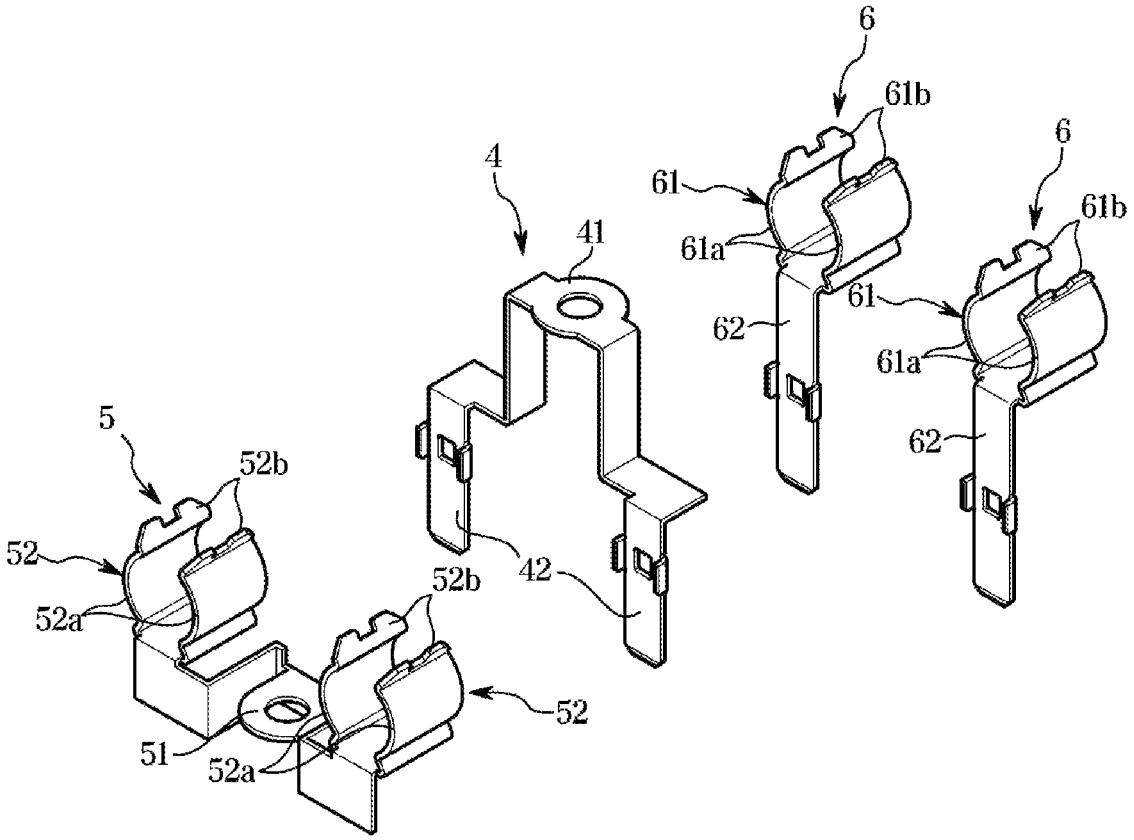
FIG. 5 is a perspective view of terminals applied to a power connector according to an exemplary embodiment of the present invention.
Figure 6:
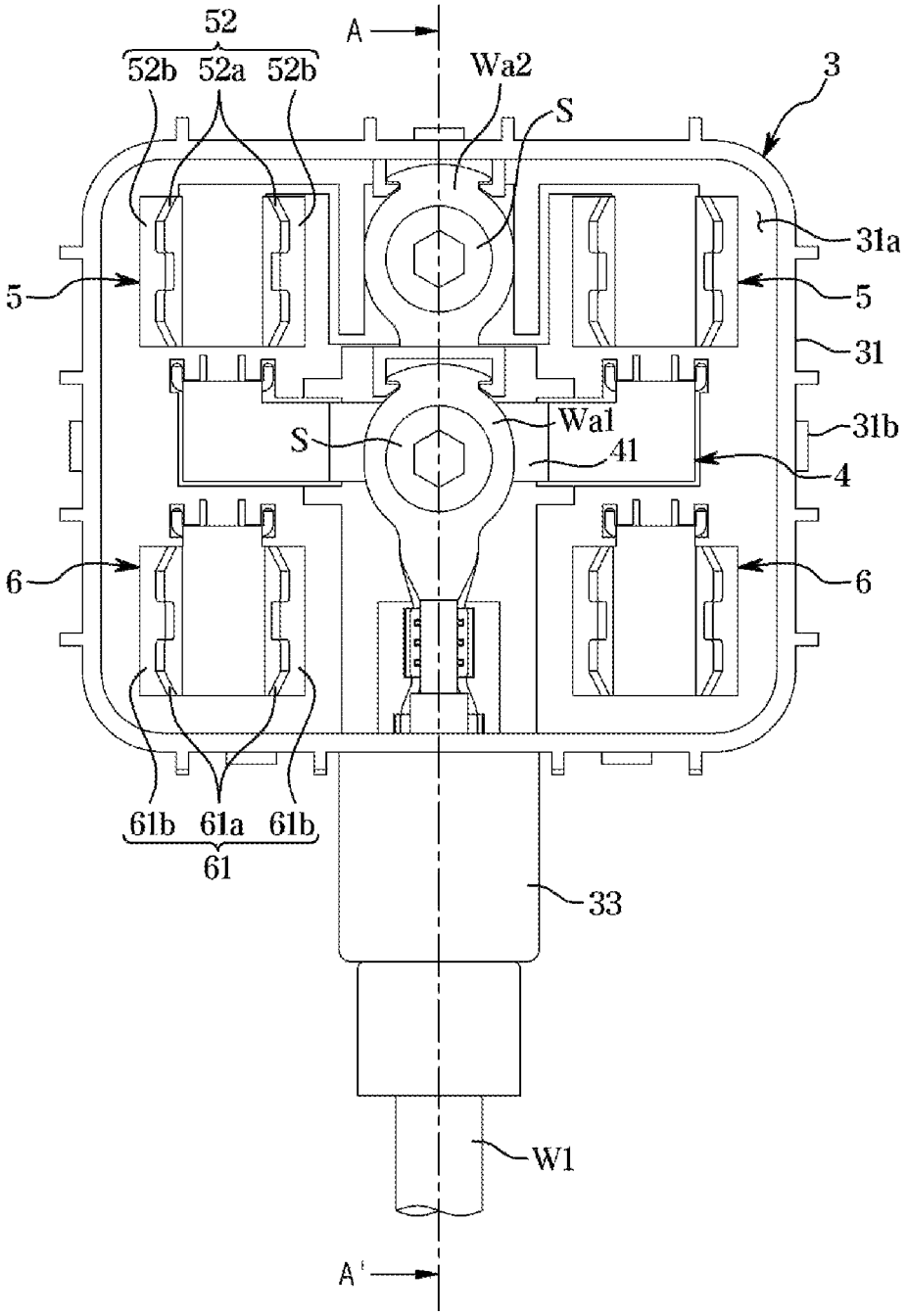
FIG. 6 is a plan view exemplarily illustrating the internal to an internal body applied to a power connector according to an exemplary embodiment of the present invention.

As shown in FIG. 5 and FIG. 6, one end portion of the first wire W1 connected to a power source is connected to the terminals 4, 5 and 6, and the terminals 4, 5 and 6 include the first terminal 4 including a plurality of first terminal portions 42 for power supply, the intermediate terminal 5 which is connected to one end portion of the second wire W2 connected to the power source and includes a plurality of first clips 52 respectively connected to first end portions of the plurality of fuses 7, and the plurality of second terminals 6 each including a second clip 61 to which each of the second end portions of the plurality of fuses 7 is connected and a second terminal portion 62 for power supply.

The first terminal 4 includes a first connection portion 41 to which the first wire W1 is connected and the two first terminal portions 42 extending from opposite sides of the first connection portion 41.

The intermediate terminal 5 includes a second connection portion 51 to which one end portion of the second wire W2 is connected and the two first clips 52 mounted on opposite sides of the second connection portion 51.

The two second terminals 6 are provided and each include the one second clip 61 and the one second terminal portion 62. That is, the power connector may include the two second terminal portions 62.

Each of the first clips 52 and each of the second clips 61 include a pair of clip portions 52*a* and 61*a* formed in an arc shape to correspond to the cylindrical fuses 7, and guide portions 52*b* and 61*b* extending outwardly from one end portion of the pair of clip portions 52*a* and 61*a* spaced from each other.

The pair of clip portions 52*a* and 61*a* are spaced from each other so that their internal circumferential surfaces face each other, and each of the fuses 7 is accommodated between the pair of clip portions 52*a* and 61*a*. The guide portions 52*b* and 61*b* guide the fuse 7 to easily enter between the pair of clip portions 52*a* and 61*a*.

Since the terminals 4, 5 and 6 are made of elastically deformable material, the pair of clip portions 52*a* and 61*a* are temporarily elastically deformed outward in a process of the fuses 7 being guided by the guide portions 52*b* and 61*b* and entering between the pair of clip portions 52*a* and 61*a*. After the fuses 7 enter between the pair of clip portions 52*a* and 61*a*, the pair of clip portions 52*a* and 61*a* are elastically restored to support the fuses 7 and thus connected to the fuses 7.

Figure 7:
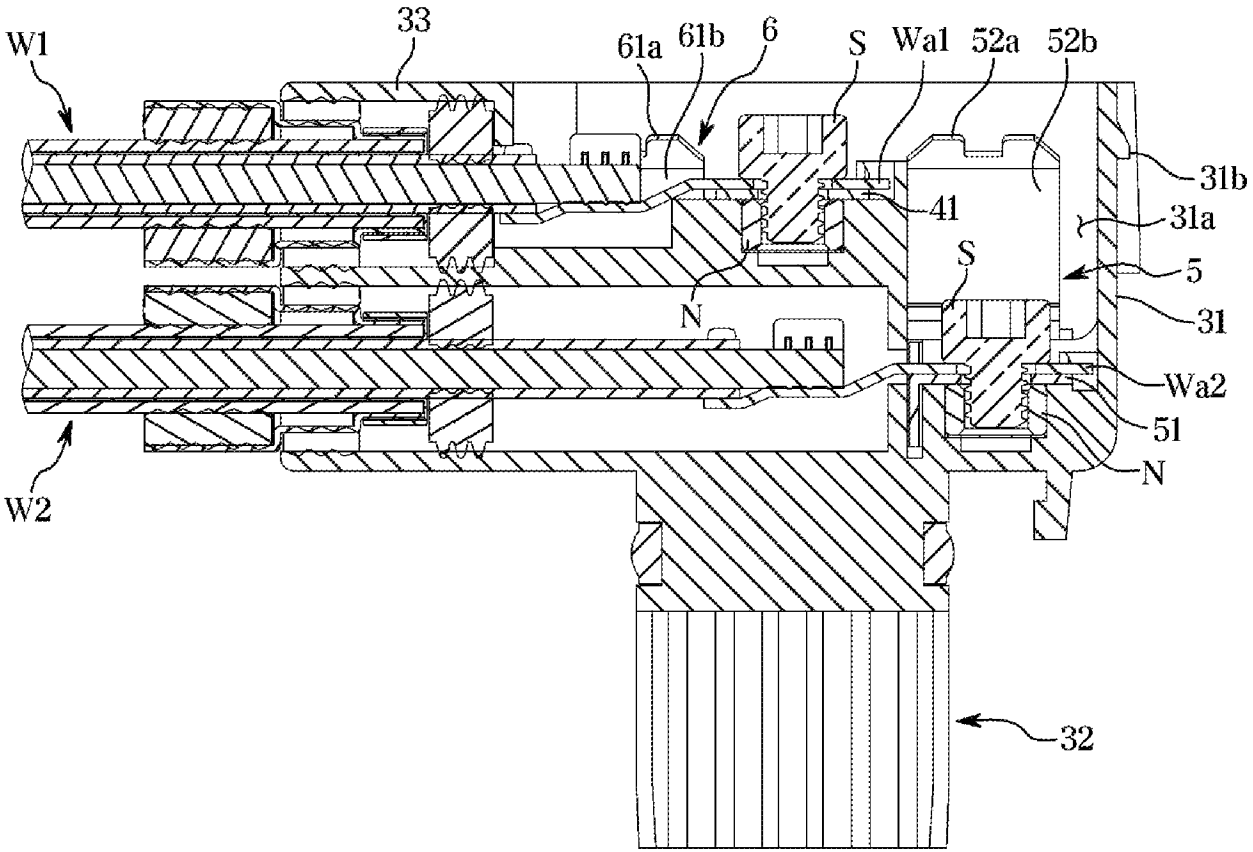
FIG. 7 is a side cross-sectional view exemplarily illustrating the internal to an internal body applied to a power connector according to an exemplary embodiment of the present invention.

Referring to FIGS. 4 and 7, the first wire W1 and the second wire W2 include ring-shaped harnesses Wa1 and Wa2 provided at one end portions thereof, respectively. The harnesses Wa1 and Wa2 are formed such that one end portions of the first wire W1 and the second wire W2 are fixed to the first connection portion 41 and the second connection portion 51 through bolts S and nuts N, respectively. Herein, the nuts N are square nuts, and the internal body 3 includes square grooves in which the square nuts N are disposed.

Figure 8:
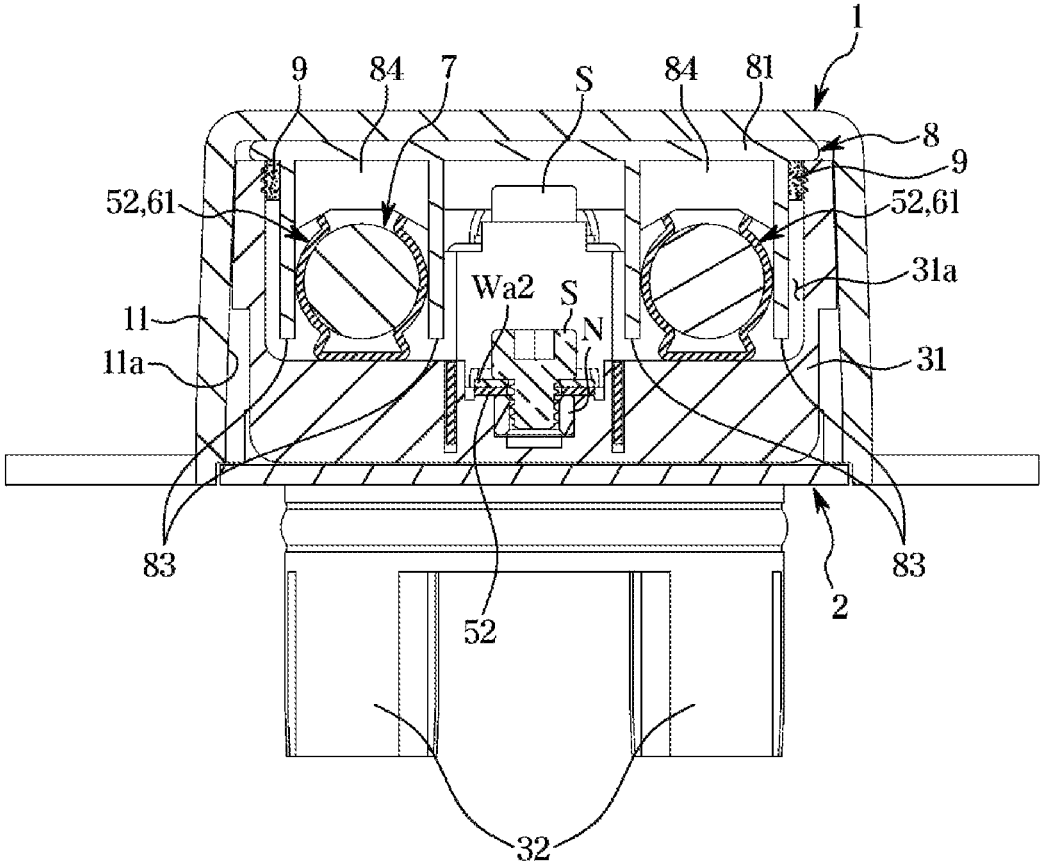
FIG. 8 is a side cross-sectional view exemplarily illustrating a state where fuses are disposed in a power connector according to an exemplary embodiment of the present invention.

Referring to FIGS. 3 and 8, the internal cover 8 includes support ribs 83 that support the first and second clips 52 and 61 by protruding into the accommodating space 31*a* in a state where the internal cover 8 mounted in the internal body 3.

The support ribs 83 protrude from an internal surface of the internal cover 8 and are configured to prevent the clip portions 52*a* and 61*a* from being deformed outward by supporting the opposite sides of the first and second clips 52 and 61.

In the exemplary embodiment of the present invention, since the power connector includes the two first clips 52 and the two second clips 61, the support ribs 83 include two pairs to support the external sides of the two first clips 52 and the two second clips 61.

The internal cover 8 includes pressing ribs 84 provided between the two support ribs 83 forming a pair. The pressing ribs 84 are configured to more reliably prevent the clip portions 52*a* and 61*a* from being deformed by pressing the upper end portions of the guide portions 52*b* and 61*b* of the first and second clips 52 and 61.

The two pressing ribs 84 are provided between the pair of support ribs 83 to support the guide portions 52*b* and 61*b* of the first and second clips 52 and 61. In the exemplary embodiment of the present invention, since the support ribs 83 include two pairs, the internal cover 8 includes the four pressing ribs 84 in total.

Figure 9:
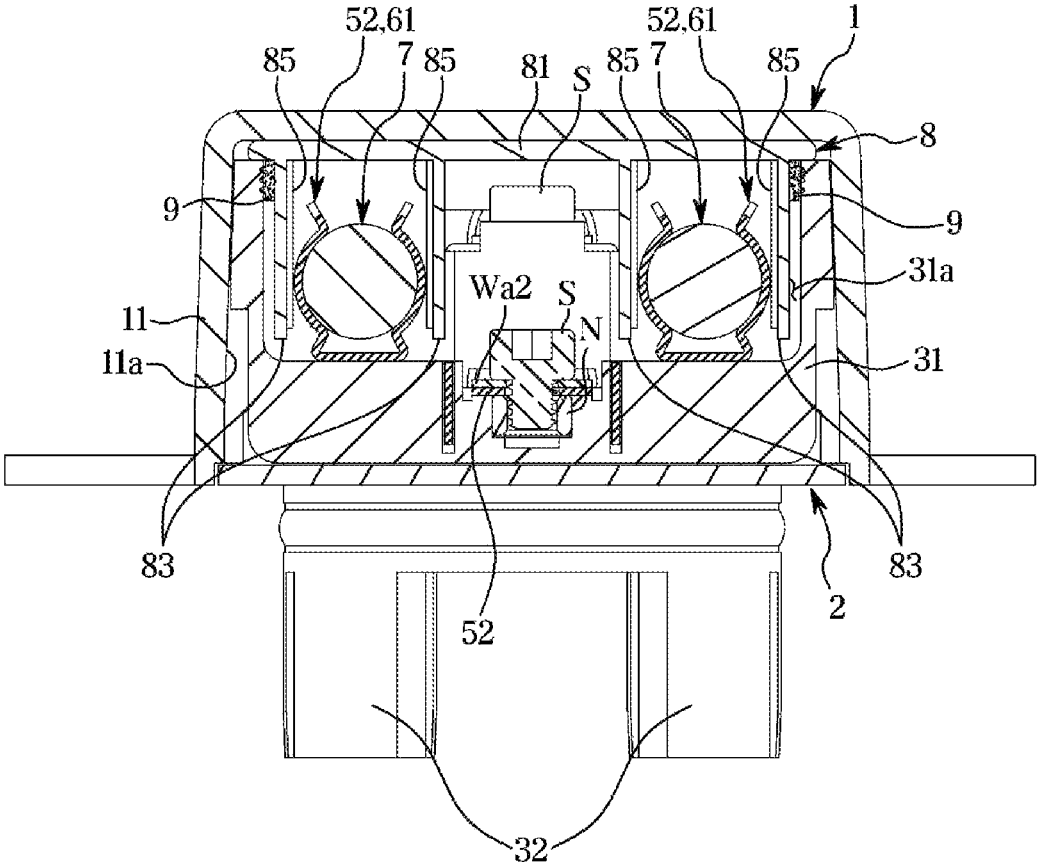
FIG. 9 is a side cross-sectional view exemplarily illustrating a state where fuses are disposed in a power connector according to various exemplary embodiments of the present invention.

Although the pressing ribs 84 are referred to as being provided between the pair of supporting ribs 83, the present invention is not limited thereto. As shown in FIG. 9, the pressing ribs 85 may be provided to support the external surfaces of the clip portions 52*a* and 61*a* by protruding from the mutually facing surfaces of the pair of support ribs 83.

As described above, since the two clip portions 52*a* and 61*a* are provided for each of the two first clips 52 and the two second clips 61, the internal cover 8 supporting the clip portions 52*a* and 61*a* includes the eight pressing ribs 85 in total.

Although the first clips 52 and the second clips 61 are each referred to as being two in number, the present invention is not limited thereto.

Figure 10:
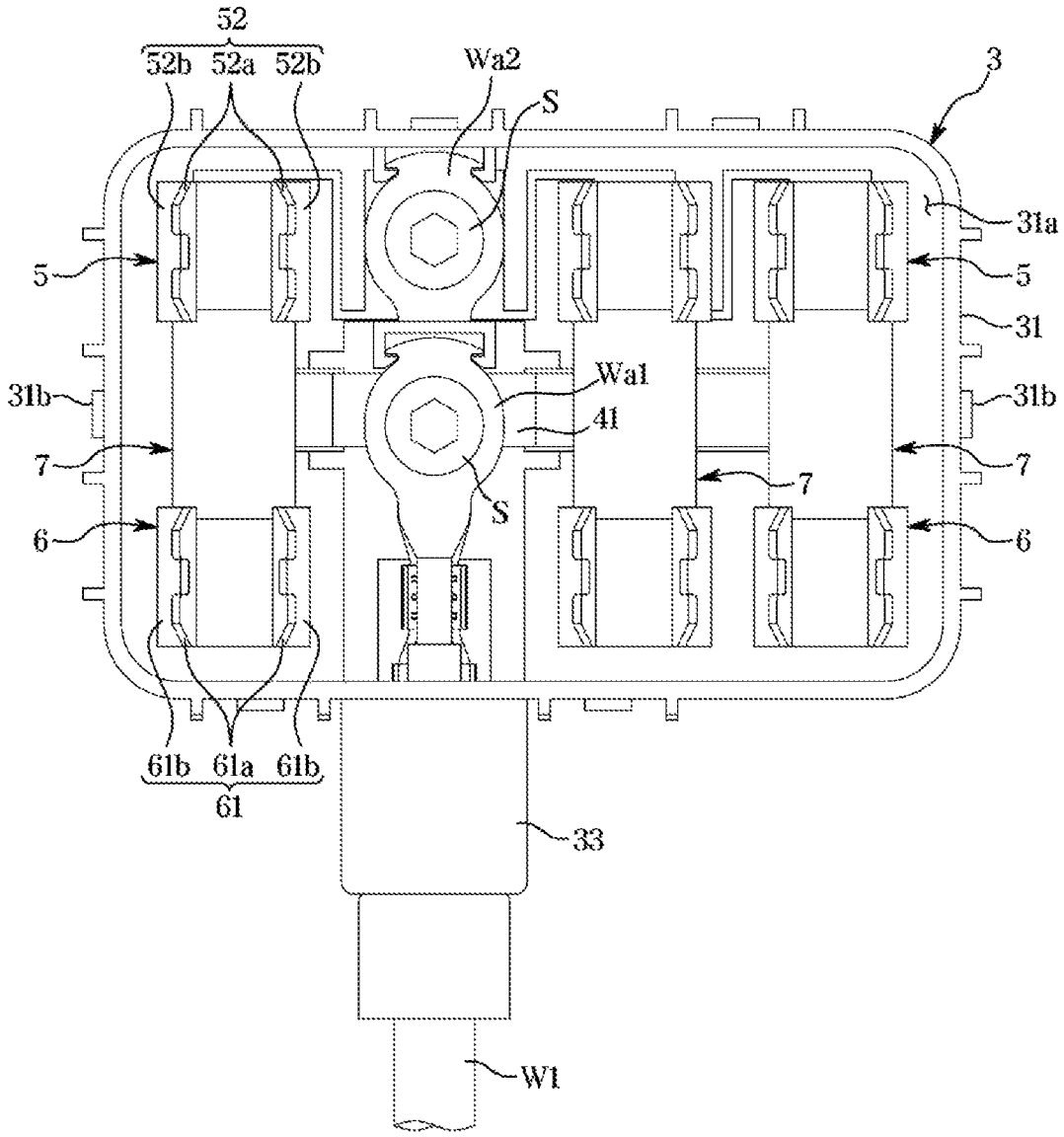
FIG. 10 is a plan view exemplarily illustrating the internal to an internal body applied to a power connector according to various exemplary embodiments of the present invention.
Figure 11:
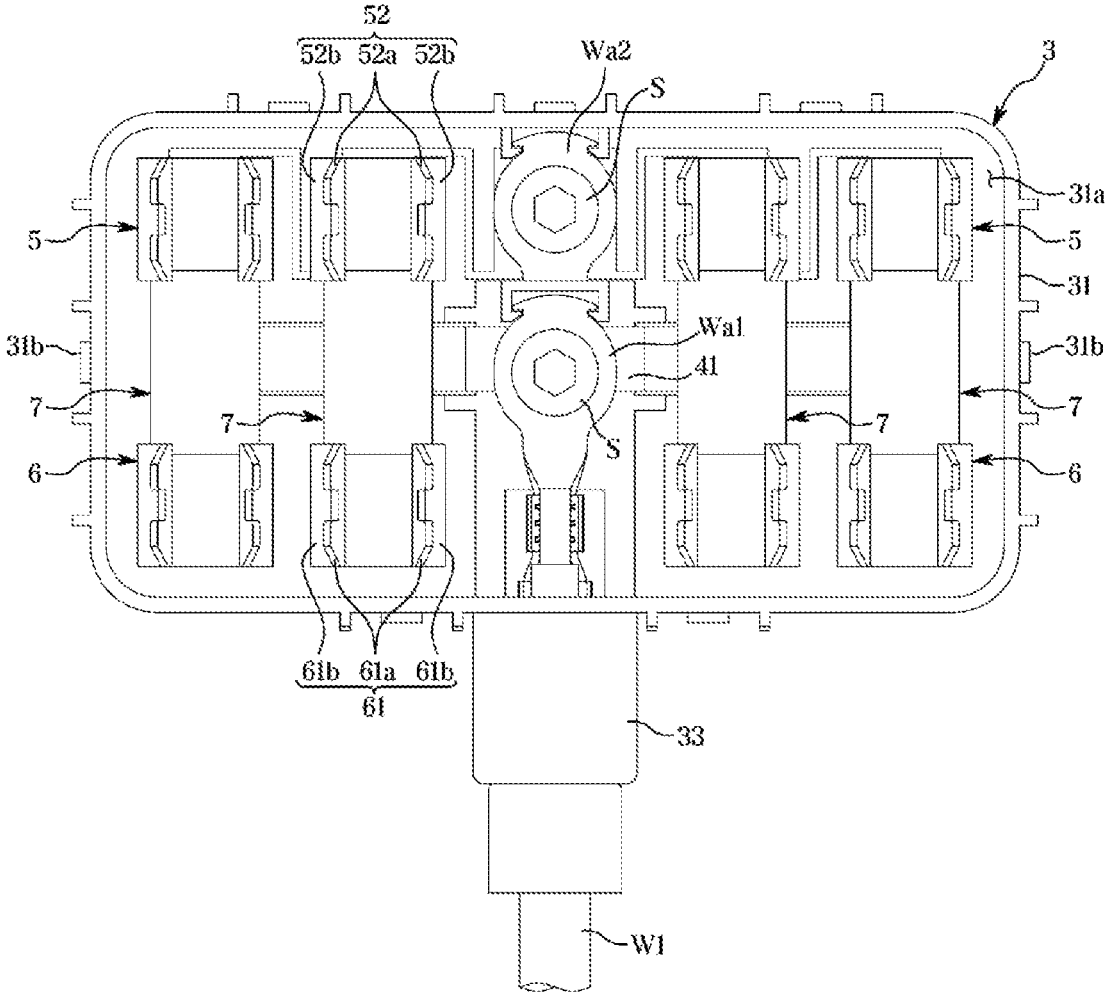
FIG. 11 is a plan view exemplarily illustrating the internal to an internal body applied to a power connector according to various exemplary embodiments of the present invention.

For example, as shown in FIG. 10, three first clips 52, each of which includes the three clip portions 52*a*, 52*b*, and 52*c* and three second clips 61, each of which includes the three clip portions 61*a*, 61*b*, and 61*c* may be provided so that power is distributed to three devices, or as shown in FIG. 11, the four first clips 52 and the four second clips 61 may be provided so that power is distributed to four devices.

As is apparent from the above, the power supply connector according to various aspects of the present invention may include a plurality of connector portions, so that power may be distributed to a plurality of devices that use electricity.

Furthermore, the power supply connector according to various aspects of the present invention, the support ribs of the internal cover support opposite sides of the clip portions in a state where the internal cover closes the accommodating space, so that the state where the fuses are disposed on the clip portions may be stably maintained.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A power connector comprising:

a plurality of fuses;

a first terminal connected to a first wire connected to a power source and including a plurality of first terminal portions for supplying power;

an intermediate terminal connected to a second wire connected to the power source and including a plurality of first clips connected to first end portions of the plurality of fuses; and a plurality of second terminals including a plurality of second clips connected to second end portions of the plurality of fuses and a plurality of second terminal portions for supplying power;

an internal body provided with an accommodating space in which the first terminal, the second terminals, the intermediate terminal and the plurality of fuses are mounted; and an internal cover covering the accommodating space, wherein the internal cover includes a plurality of pairs of support ribs protruding from a surface of the internal cover to support the plurality of first clips and the plurality of second clips.

2. The power connector of claim 1, wherein the first terminal includes a first connection portion connected to the first wire, and the pair of first terminal portions extending from opposite end portions of the first connection portion, wherein the intermediate terminal further includes a second connection portion connected to the second wire, and a pair of second clips provided at opposite end portions of the second connection portion, and wherein the plurality of second terminals includes a pair of second terminals.

3. The power connector of claim 1, further including:

a sealing member positioned between the internal body and the internal cover and sealing a gap formed between the internal body and the internal cover.

4. The power connector of claim 1, wherein the internal body includes a plurality of locking protrusions protruding from an external surface of the internal body, and wherein the internal cover includes:

a plurality of retaining portions extending from external end portions of the internal cover; and a plurality of retaining holes provided at the plurality of retaining portions, wherein the plurality of locking protrusions is configured to be inserted into the plurality of retaining holes.

5. The power connector of claim 1, wherein each of the plurality of fuses has a circular cross-section, and wherein each of the plurality of first clips and the plurality of second clips includes:

a pair of clip portions formed in an arc shape corresponding to the fuses and having internal circumferential surfaces which face each other; and a pair of guide portions extending from the pair of clip portions to guide the fuses into the pair of clip portions.

6. The power connector of claim 5, further including:

a main housing having an accommodating space accommodating the internal body therein; and a cover housing covering the accommodating space, wherein the internal body includes a pair of connector parts in which the first terminal portions and the second terminal portion are respectively mounted, and the cover housing includes a through hole through which the pair of connector parts protrude outwards of the cover housing.

7. The power connector of claim 5, wherein the internal cover includes the plurality of pairs of ribs supporting external surfaces of the pair of clip portions.

8. The power connector of claim 7, wherein the internal cover further includes a pressing rib mounted between the pair of support ribs and configured to press the guide portions mounted on the pressing rib.

9. The power connector of claim 7, wherein the internal cover further includes a pair of pressing ribs protruding from mutually facing surfaces of the pair of support ribs to respectively support the plurality of clip portions.

* * * * *